US011352904B2

(12) United States Patent
Moulton et al.

(10) Patent No.: US 11,352,904 B2
(45) Date of Patent: Jun. 7, 2022

(54) SUPPORT ASSEMBLY FOR A ROTARY MACHINE

(71) Applicant: Solar Turbines Incorporated, San Diego, CA (US)

(72) Inventors: David H. Moulton, Poway, CA (US); Wolfgang Faller, San Diego, CA (US); Jess Lee Freeman, Poway, CA (US)

(73) Assignee: Solar Turbines Incorporated, San Diego, CA (US)

( * ) Notice: Subject to any disclaimer, the term of this patent is extended or adjusted under 35 U.S.C. 154(b) by 225 days.

(21) Appl. No.: 16/745,600

(22) Filed: Jan. 17, 2020

(65) Prior Publication Data

US 2021/0222586 A1 Jul. 22, 2021

(51) Int. Cl.

| | |
|---|---|
| ***F04D 17/08*** | (2006.01) |
| ***F04D 29/058*** | (2006.01) |
| ***F01D 25/16*** | (2006.01) |
| ***F04D 29/059*** | (2006.01) |

(52) U.S. Cl.

CPC ..... *F01D 25/16* (2013.01); *F04D 29/058* (2013.01); *F04D 29/059* (2013.01)

(58) Field of Classification Search

CPC .. F04D 29/058; F04D 29/059; F16C 32/0402; F16C 2360/24; F16C 2360/44; H02K 7/09

See application file for complete search history.

(56) References Cited

U.S. PATENT DOCUMENTS

| | | | | |
|---|---|---|---|---|
| 4,982,126 | A | 1/1991 | Jolivet et al. | |
| 5,486,730 | A * | 1/1996 | Ludwig | H02K 1/278 156/293 |
| 6,746,215 | B2 | 6/2004 | Tani et al. | |
| 9,169,847 | B2 | 10/2015 | Krehbiel | |
| 9,746,027 | B2 * | 8/2017 | Anders | F16C 39/02 |
| 10,208,759 | B2 * | 2/2019 | Carrasco | F04D 29/622 |
| 10,697,421 | B2 * | 6/2020 | Mei | F01D 25/16 |
| 2014/0112773 | A1 * | 4/2014 | Brailean | F04D 29/058 415/229 |
| 2014/0191604 | A1 * | 7/2014 | Hawkins | F16C 32/0442 310/90.5 |

FOREIGN PATENT DOCUMENTS

| | | | |
|---|---|---|---|
| CN | 204312276 | U | 5/2015 |
| CN | 103362821 | B | 10/2015 |
| JP | 6238830 | B2 | 11/2017 |
| JP | 2019110645 | | 7/2019 |
| JP | WO2018168044 | A1 | 7/2019 |
| KR | 101938797 | | 1/2019 |
| WO | 2019076419 | | 4/2019 |

* cited by examiner

*Primary Examiner* — Justin D Seabe

(74) *Attorney, Agent, or Firm* — Procopio, Cory, Hargreaves & Savitch LLP

(57) ABSTRACT

A magnetic bearing assembly for a rotary machine may lose power and fail to support the rotating assembly resulting in damage to magnetic bearing assembly and/or other components. An auxiliary bearing assembly may be used to support the rotating assembly during such a failure. The auxiliary bearing assembly is located radially inwards of the magnetic bearing assembly and may reduce resonance and/or whirl of the rotating assembly during failure of the magnetic bearing assembly.

17 Claims, 3 Drawing Sheets

SUPPORT ASSEMBLY FOR A ROTARY MACHINE

TECHNICAL FIELD

The present disclosure generally pertains to a support assembly for a rotary machine, and is more particularly directed toward gas compressors.

BACKGROUND

The use of magnetic bearings in rotary machines such as gas compressors is increasing. Magnetic bearings work on the principle of electromagnetic suspension. The use of electromagnetic suspension reduces or eliminates friction losses in centrifugal gas compressors.

Magnetic bearings in rotary machines are generally arranged with multiple windings or electric coils surrounding a shaft formed from a ferromagnetic material. Some magnetic bearings use a ferromagnetic lamination on the shaft when the shaft is not formed from a ferromagnetic material. The windings in a radial magnetic bearing radially surround the shaft and produce a magnetic field that tends to attract the rotor shaft. The attractive forces of the windings may be controlled by varying the current in each winding. Auxiliary bearings can be used to support the rotor shaft in case the magnetic bearings fail.

U.S. Pat. No. 9,169,847, to Krehbiel et al. discloses that radial magnetic bearings of a centrifugal gas compressor may lose power and fail to support the shaft resulting in damage to the shaft. Auxiliary bearings may be used to support the shaft during such a failure. A landing guard may be installed as a sacrificial piece between the shaft and the auxiliary bearings. The landing guard includes slots that may be used with pins in the shaft to prevent an angular displacement between the landing guard and the shaft.

The present disclosure is directed toward improvements in the art.

SUMMARY

A rotary machine is disclosed herein. The rotary machine including a shaft having an axis of rotation. The rotary machine further including a rotor coupled to and extending circumferentially around the shaft. The rotor having an inner rotor surface proximate to the shaft and an outer rotor surface opposite from the inner rotor surface. The rotary machine further including a magnetic bearing assembly positioned adjacent to the outer rotor surface. The rotary machine further including an auxiliary bearing assembly positioned adjacent to the inner rotor surface and radially inward of the magnetic bearing assembly.

DETAILED DESCRIPTION

The detailed description set forth below, in connection with the accompanying drawings, is intended as a description of various embodiments and is not intended to represent the only embodiments in which the disclosure may be practiced. The detailed description includes specific details for the purpose of providing a thorough understanding of the embodiments. However, it will be apparent to those skilled in the art that embodiments of the invention can be practiced without these specific details. In some instances, well-known structures and components are shown in simplified form for brevity of description.

Figure 1:
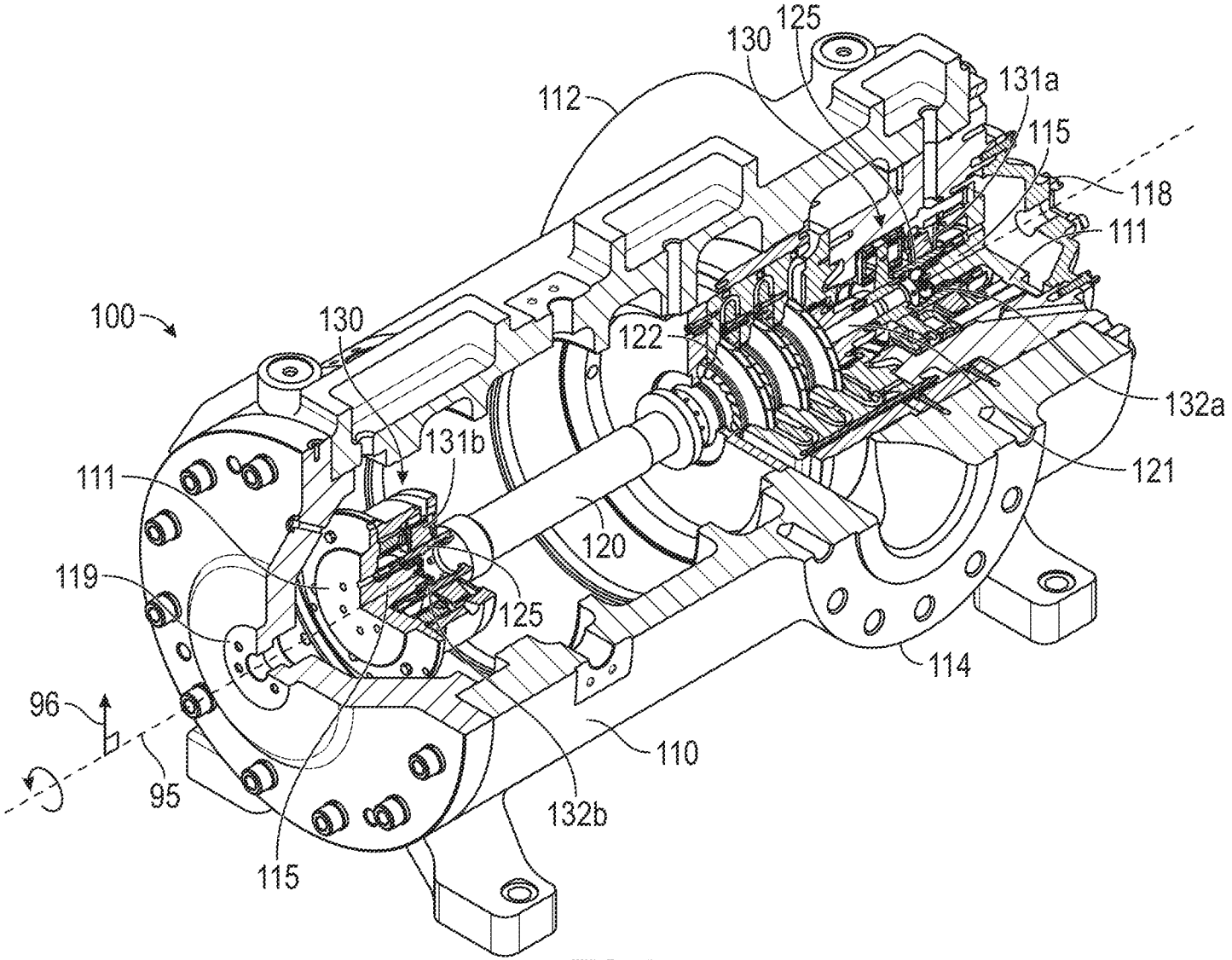
FIG. 1 is a cutaway illustration of an machine.

FIG. 1 is a cutaway illustration of an exemplary rotary machine 100 (sometimes referred to as a gas compressor). Some of the surfaces have been left out or exaggerated (here and in other figures) for clarity and ease of explanation. The disclosure may generally reference an axis of rotation 95 of the gas compressor 100, which may be generally defined by the longitudinal axis of its shaft 121. The axis of rotation 95 may be common to or shared with various other concentric components of the gas compressor 100. All references to radial, axial, and circumferential directions and measures refer to axis of rotation 95, unless specified otherwise, and terms such as "inner" and "outer" generally indicate a lesser or greater radial distance from the axis of rotation 95, wherein a radial 96 may be in any direction perpendicular and radiating outward from axis of rotation 95.

The gas compressor 100 (sometimes referred to as the integrated gas compressor or compressor) includes a housing 110, a bearing disk 111, a suction port 114, a discharge port 112, and a rotating assembly 120, and a support assembly 130. The housing can have a first end 118 and a second end 119 opposite the first end 118. The bearing disk 111 can be coupled to the housing 110. In an embodiment the bearing disk 111 includes a bearing post 115 extending towards the center of the compressor 100. The bearing post 115 can be centered along the axis of rotation 95.

The rotating assembly 120 can include a shaft 121, centrifugal impellers 122, and a rotor 125 (sometimes referred to as a radial magnetic bearing rotor). Where the drawing includes multiple instances of the same feature, for centrifugal impellers 122, the reference number is only shown in connection with one instance of the feature to improve the clarity and readability of the drawing. This is also true in other drawings which include multiple instances of the same feature.

Process gas enters the centrifugal gas compressor 100 at the suction port 114 formed on the housing 110. The process gas is compressed by one or more centrifugal impellers 122 rotating about the shaft 121. The compressed process gas exits the centrifugal gas compressor 100 at the discharge port 112 that is formed on the housing 110.

The shaft 121 and attached elements may be supported by the support assembly 130 and other bearing assemblies or structures. In an embodiment the shaft 121 can be a tie bolt and be threaded at some portions. The support assembly 130 can include a first magnetic bearing assembly 131*a*, a second magnetic bearing assembly 131*b*, a first auxiliary bearing assembly 132*a*, and a second auxiliary bearing assembly 132*b*. Sometimes the first magnetic bearing assembly 131*a* and the second magnetic bearing assembly 131*b* are generally referred to as magnetic bearing assembly 131 and the first auxiliary bearing assembly 132*a* and the second auxiliary bearing assembly 132*b* are generally referred to as auxiliary bearing assembly 132. Descriptions of the first magnetic bearing assembly 131*a* may be applied to the second magnetic bearing assembly 131*b* unless specified otherwise. Similarly, descriptions of the first auxiliary bearing assembly 132*a* may be applied to the second auxiliary bearing assembly 132*b* unless specified otherwise.

In an embodiment the first magnetic bearing assembly 131*a* and the first auxiliary bearing assembly 132*a* are located proximate to the first end 118 and the second magnetic bearing assembly 131*b* and the second auxiliary bearing assembly 132*b* are located proximate to the second end 119.

Figure 2:
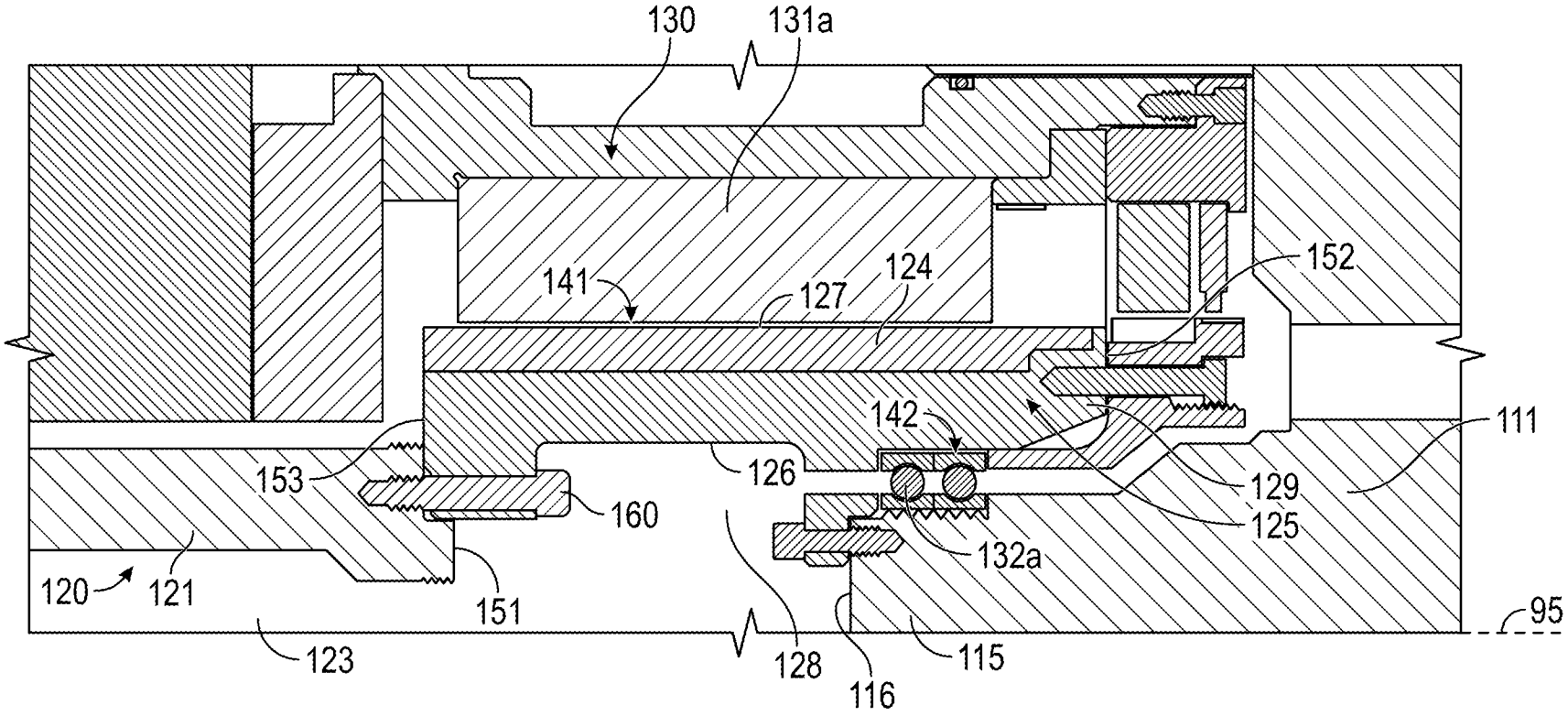
FIG. 2 is a partial cross-sectional view of the bearing assemblies and other components proximate to the first end of the machine from FIG. 1.

FIG. 2 is a partial cross-sectional view of the bearing assemblies, the upper half of the shaft, and other components proximate to the first end of the machine from FIG. 1. The shaft 121 can be hollow and can define a shaft cavity 123. In other examples the shaft 121 is solid. The shaft 121 can have a shaft end 151 proximate to the bearing post 115. The shaft can be threaded proximate to the shaft end 151.

The rotor 125 can be concentric to the shaft 121. The rotor 125 can extend along the shaft 121 and can circumferentially extend around the shaft 121. In an embodiment, the rotor 125 can be coupled to the shaft 121. During operation of the gas compressor 100 the rotor 125 can rotate with the shaft 121.

The rotor 125 can include a rotor body 129, a rotor first end 152, and a rotor second end 153 opposite the rotor first end 152. The rotor second end 153 can be positioned adjacent to the shaft 121. The rotor first end 152 can be positioned proximate to the bearing disk 111.

In an embodiment the rotor 125 can be shaped as a hollow cylinder such as a tube. In other examples a portion of the rotor 125 is a hollow cylinder and a portion is a solid cylinder.

The rotor 125 can include a lamination 124 located radially outward of the majority of the rotor body 129. The lamination 124 can be positioned within a void of the rotor body 129. The lamination 124 can be attached to the rotor body 129 by interference fit. The lamination 124 can include ferromagnetic materials.

The rotor 125 can be hollow and include an inner rotor surface 126 oriented towards the axis of rotation 95. The rotor 125 can include an outer rotor surface 127 positioned opposite the inner rotor surface 126 and along the lamination 124. The outer rotor surface 127 can face radially outward with respect to the shaft 121. The inner rotor surface 126 can define a rotor cavity 128. In an embodiment the bearing post 115 can extend from the bearing disk 111 into the rotor cavity 128. In an embodiment the shaft end 151 is located within the rotor cavity 128 and may not extend axially through the housing 110 (shown in FIG. 1). In an embodiment the shaft end 151 may not be located axially between the rotor first end 152 and the first end 118. In an embodiment the shaft end 151 can be located axially between the rotor first end 152 and the rotor second end 153.

The first magnetic bearing assembly 131*a* can be positioned within the housing 110. The first magnetic bearing assembly 131*a* can be shaped as an annulus. The first magnetic bearing assembly 131*a* can be positioned radially outward from the lamination 124 with a first bearing gap 141 located between the first magnetic bearing assembly 131*a* and the lamination 124 or outer rotor surface 127. The first bearing gap 141 can be approximately 0.02". The first magnetic bearing assembly 131*a* can be aligned axially with lamination 124 with respect to the axis of rotation 95 and the shaft 121.

The first auxiliary bearing assembly 132*a* can be positioned within the housing 110. The first auxiliary bearing assembly 132*a* can be shaped as an annulus. The first auxiliary bearing assembly 132*a* can be radially smaller than the lamination 124. The first auxiliary bearing assembly 132*a* can be positioned adjacent to the inner rotor surface 126 and radially inward of the first magnetic bearing assembly 131*a*. The first auxiliary bearing assembly 132*a* can extend circumferentially adjacent to the inner rotor surface 126. The first auxiliary bearing assembly 132*a* can be positioned within the rotor 125 such as within the rotor cavity 128. The auxiliary bearing assembly 132*a* can be positioned radially between the bearing post 115 and the rotor 125.

The first auxiliary bearing assembly 132*a* can be positioned radially inward from the rotor 125 with a second bearing gap 142 located between the first auxiliary bearing assembly 132*a* and the inner rotor surface 126. The second bearing gap can be approximately 0.01". In an embodiment the first bearing gap 141 is radially larger than the second bearing gap 142.

The first magnetic bearing assembly 131*a* and the first auxiliary bearing assembly 132*a* can axially overlap with the rotor 125 with respect to the axis of rotation 95 and the shaft 121.

In an embodiment the first magnetic bearing assembly 131*a* is axially positioned between the rotor first end 152 and rotor second end 153 with respect to the axis of rotation 95. In an embodiment the first auxiliary bearing assembly 132*a* is axially positioned between the rotor first end 152 and rotor second end 153 with respect to the axis of rotation 95.

The bearing post 115 can have a bearing post end 116 located proximate to the shaft end 151. In an embodiment the bearing post end 116 is axially positioned between the rotor first end 152 and rotor second end 153 with respect to the axis of rotation 95.

Figure 3:
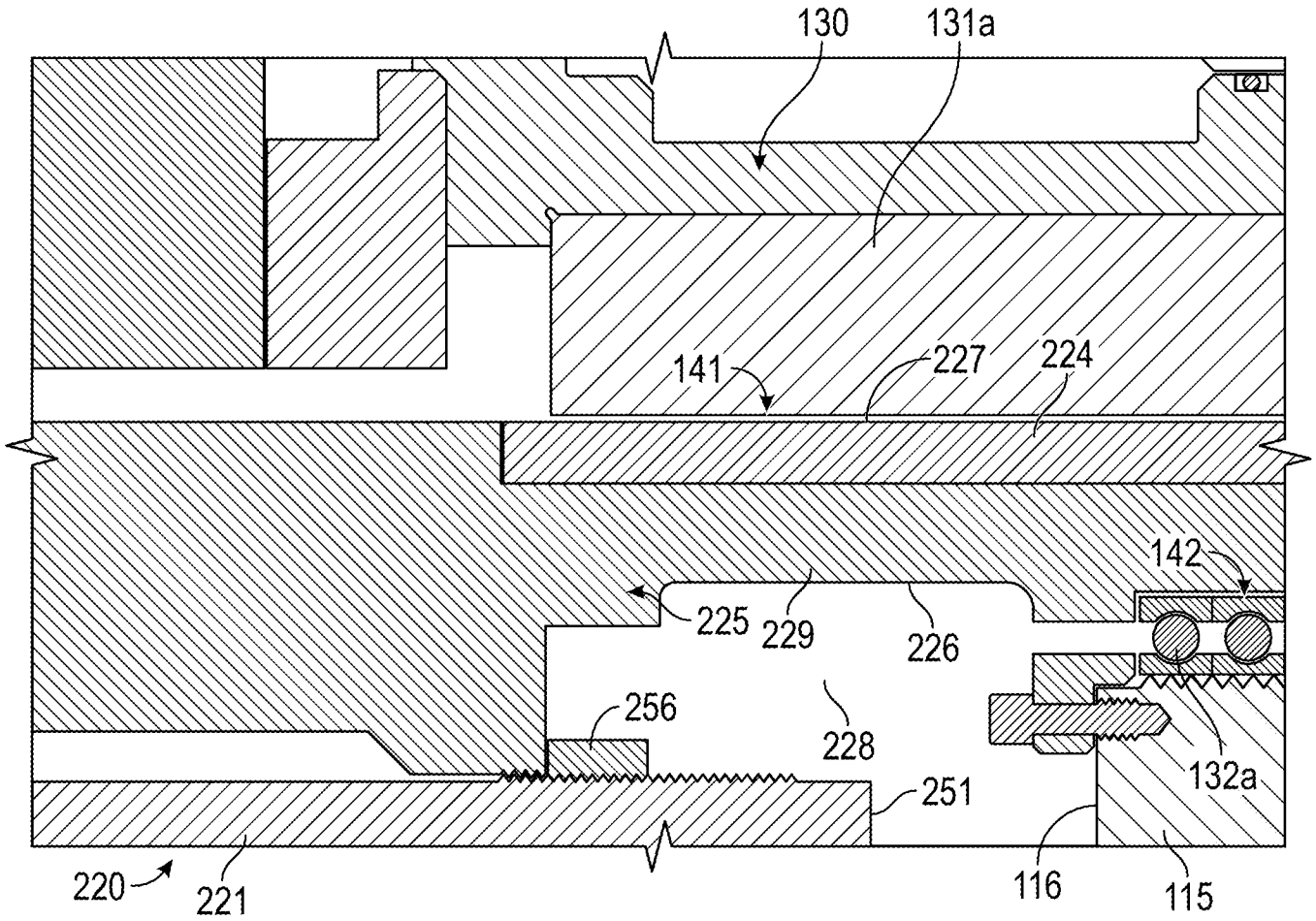
FIG. 3 is a partial cross-sectional view, similar to FIG. 2, of the bearing assemblies, an exemplary rotating assembly, and other components proximate to the first end of the machine.

FIG. 3 is a partial cross-sectional view, similar to FIG. 2, of the bearing assemblies, an exemplary rotating assembly, and other components proximate to the first end of the machine. A rotating assembly 220 can include a shaft 221 and a rotor 225. Structures and features previously described in connection with earlier described embodiments may not be repeated here with the understanding that, when appropriate, that previous description applies to the embodiment depicted in FIG. 3. Additionally, the emphasis in the following description is on variations of previously introduced features or elements.

The shaft 221 can include a shaft end 251. The rotor 225 can include an inner rotor surface 226, an outer rotor surface 227, and a rotor cavity 228. The rotor 225 can extend axially along the shaft 221. The rotor 225 can couple to the radially outward surface of the shaft 221. In an embodiment the rotor 225 has a threaded portion that can couple with a threaded portion of the shaft 221. The shaft 221 can include a shaft fastener 256 that can facilitate coupling between the rotor 225 and the shaft 221. The location of coupling between the rotor 225 and the shaft 221 can be axially spaced from the shaft end 251.

INDUSTRIAL APPLICABILITY

Rotating assemblies 120 are used in several industries including, turbines, gas turbine engines, power generators, and gas compressors. Centrifugal gas compressors are used to move process gas from one location to another. Centrifugal gas compressors can include an integral motor, sometimes referred to as integrated gas compressors. Centrifugal gas compressors 100 are often used in the oil and gas industries to move natural gas in a processing plant or in a pipeline. Centrifugal gas compressors 100 are driven by gas turbine engines, electric motors, or any other power source.

There is a desire to achieve greater efficiencies and reduce emissions in large industrial machines such as centrifugal gas compressors. Installing electric motors and magnetic bearings in a centrifugal gas compressor may accomplish both desires. Centrifugal gas compressors 100 may achieve greater efficiencies with magnetic bearings by eliminating any contact between the bearings and rotary element. Contact between the bearings and the rotary element generally causes frictional losses to occur. Magnetic bearings may use electromagnetic forces to levitate and support rotary elements without physically contacting the rotary elements and eliminating the frictional losses.

Using magnetic bearings may reduce or eliminate production of undesirable emissions. These emissions may be produced by leaking or burning a lubricant such as oil. Eliminating the contact and frictional losses between the rotary element and bearings by supporting the rotary element with magnetic bearings may eliminate or reduce the need for lubricants in centrifugal gas compressors. With this elimination or reduction of lubricants or oil, the emissions in centrifugal gas compressors may be reduced or eliminated. Eliminating lubricants may also eliminate the need for the valves, pumps, filters, and coolers associated with lubrication systems.

In centrifugal gas compressor 100 the magnetic bearing assembly 131 can partially support the rotating assembly 120 radially using magnetic levitation. The magnetic bearing assembly 131 uses windings, also referred to as electromagnets, to produce a magnetic field. The magnetic field is generated by the electrical currents traversing windings. The attractive force of each winding may be controlled by varying the electric current traversing the winding. The magnetic field produced by windings can interact with the ferromagnetic material of lamination 124. The magnetic forces act on rotating assembly 120 through lamination 124 to levitate rotating assembly 120 without any contact between the magnetic bearing assembly 131 and the lamination 124.

Designing magnetic bearings to replace mechanical bearings in centrifugal gas compressors does not come without its challenges. Magnetic bearings may lose power or fail. Without support from the magnetic bearings the rotating assembly 120 may be damaged when the rotating assembly 120 falls and contacts elements of the magnetic bearings or elements of the centrifugal gas compressor.

The auxiliary bearing assembly 132, such as angular contact bearings or bushings, are installed in centrifugal gas compressor 100. The auxiliary bearing assembly 132 prevents rotating assembly 120 from contacting the magnetic bearing assembly 131 or other parts of centrifugal gas compressor 100 if the magnetic bearing assembly 131 fails or loses power.

Bearing assemblies such as the magnetic bearing assembly 131 and the auxiliary bearing assembly 132 can help control resonance of the rotating assembly 120 during operation of the gas compressor 100. Typically the closer a support assembly 130 is located to an end of the rotating assembly, such as the first end 118 and the second end 119, the longer the unsupported shaft length and the stronger the resonance. Positioning the magnetic bearing assembly 131 and/or the auxiliary bearing assembly 132 can affect the resonance performance of the rotating assembly 120.

Typically auxiliary bearing assemblies are limited to be axially spaced from magnetic bearing assemblies. In embodiments disclosed, the auxiliary bearing assembly 132 is axially aligned with a portion of the magnetic bearing assembly 131 and can improve the resonance performance of the rotating assembly 120.

The larger auxiliary bearing become, the more susceptible them become to higher speeds and therefore increased wear of the ball bearings located within. Typically auxiliary bearing assemblies are limited to be positioned radially outwards of a rotor, leading to larger auxiliary bearing assemblies. In embodiments disclosed, the auxiliary bearing assembly 132 is positioned radially inwards of the rotor 125, allowing for a generally smaller auxiliary bearing assembly 132 in comparison of an auxiliary bearing assembly positioned radially outwards of the rotor 125.

It will be understood that the benefits and advantages described above may relate to one embodiment or may relate to several embodiments. Aspects described in connection with one embodiment are intended to be able to be used with the other embodiments. Any explanation in connection with one embodiment applies to similar features of the other embodiments, and elements of multiple embodiments can be combined to form other embodiments. The embodiments are not limited to those that solve any or all of the stated problems or those that have any or all of the stated benefits and advantages.

The preceding detailed description is merely exemplary in nature and is not intended to limit the invention or the application and uses of the invention. The described embodiments are not limited to use in conjunction with a particular type of gas compressor. Hence, although the present embodiments are, for convenience of explanation, depicted and described as being implemented in a centrifugal gas compressor, it will be appreciated that it can be implemented in various other types of compressors and machines with rotating components, and in various other systems and environments. Furthermore, there is no intention to be bound by any theory presented in any preceding section. It is also understood that the illustrations may include exaggerated dimensions and graphical representation to better illustrate the referenced items shown, and are not consider limiting unless expressly stated as such.

What is claimed is:

1. A rotary machine, the rotary machine comprising:

a shaft having a first end, a second end opposite the first end and an axis of rotation;

a first rotor coupled to and extending circumferentially around the shaft proximate the first end of the shaft, the first rotor having a first inner rotor surface proximate to the shaft, and a first outer rotor surface opposite from the first inner rotor surface;

a first magnetic bearing assembly positioned adjacent to the first outer rotor surface;

a first auxiliary bearing assembly positioned adjacent to the first inner rotor surface and radially inward of the first magnetic bearing assembly and at least partially axially overlapping with the first magnetic bearing assembly;

a second rotor coupled to and extending circumferentially around the shaft proximate the second end of the shaft, the second rotor having a second inner rotor surface proximate to the shaft, and a second outer rotor surface opposite from the second inner rotor surface;

a second magnetic bearing assembly positioned adjacent to the second outer rotor surface; and a second auxiliary bearing assembly positioned adjacent to the second inner rotor surface and radially inward of the second magnetic bearing assembly and at least partially axially overlapping with the second magnetic bearing assembly.

2. The rotary machine of claim 1, wherein the first magnetic bearing assembly and the first auxiliary bearing assembly overlap along the axis of rotation with the first rotor located in between.

3. The rotary machine of claim 1, wherein the rotary machine further comprises a first bearing post centered along the axis of rotation, and wherein the first auxiliary bearing assembly is positioned radially between the first bearing post and the first rotor.

4. The rotary machine of claim 1, wherein the rotary machine further includes a first gap located between the first rotor and the first magnetic bearing assembly, and a second gap located between the first rotor and the first auxiliary bearing assembly, wherein the first gap has a larger radius than the second gap.

5. The rotary machine of claim 1, wherein first rotor further includes a lamination of ferromagnetic materials.

6. The rotary machine of claim 5, wherein the first auxiliary bearing assembly is radially smaller than the lamination.

7. A rotary machine, the rotary machine comprising:

a shaft having a first end and a second end opposite the first end;

a first rotor coupled to the shaft proximate to the first end of the shaft, the rotor having a rotor cavity;

a second rotor coupled to the shaft proximate to the second end of the shaft, the rotor having a rotor cavity;

a first magnetic bearing assembly positioned radially outward of the first rotor and proximate the first end of the shaft;

a first auxiliary bearing assembly positioned radially within the first rotor, the first auxiliary bearing assembly axially overlapping with a portion of the first magnetic bearing assembly with respect to the shaft;

a second magnetic bearing assembly positioned radially outward of the second rotor; and a second auxiliary bearing assembly positioned radially within the second rotor, the second auxiliary bearing assembly axially overlapping with a portion of the second magnetic bearing assembly with respect to the shaft.

8. The rotary machine of claim 7, wherein the rotary machine further includes a first gap located between the first rotor and the first magnetic bearing assembly, and a second gap located between the first rotor and the first auxiliary bearing assembly, wherein the first gap is larger than the second gap.

9. The rotary machine of claim 7, wherein the first auxiliary bearing assembly is positioned radially inward of the magnetic bearing assembly.

10. The rotary machine of claim 7, wherein the rotary machine further comprises a bearing post centered along the axis of rotation, and wherein the first auxiliary bearing assembly is positioned between the bearing post and the first rotor.

11. The rotary machine of claim 10, wherein the bearing post extending into the first rotor cavity.

12. A rotary machine, the rotary machine comprising:

a shaft having a first end and a second end opposite the first end;

a first rotor concentric to the shaft and proximate the first end of the shaft;

a second rotor concentric to the shaft and proximate the second end of the shaft;

a first magnetic bearing assembly positioned adjacent to and radially outward of the first rotor;

a first auxiliary bearing assembly positioned radially within the first rotor and axially overlapping with the first magnetic bearing assembly;

a second magnetic bearing assembly positioned adjacent to and radially outward of the second rotor; and a second auxiliary bearing assembly positioned radially within the second rotor and axially overlapping with the second magnetic bearing assembly.

13. The rotary machine of claim 12, wherein the rotary machine further includes a first gap located between the second rotor and the second magnetic bearing assembly, and a second gap located between the second rotor and the second auxiliary bearing assembly, wherein the first gap is larger than the second gap.

14. The rotary machine of claim 12, wherein the first auxiliary bearing assembly extends circumferentially adjacent to an inner rotor surface.

15. The rotary machine of claim 12, wherein the rotary machine further includes a first gap located between the first rotor and the first magnetic bearing assembly, and a second gap located between the first rotor and the first auxiliary bearing assembly, wherein the first gap is larger than the second gap.

16. The rotary machine of claim 12, wherein the first auxiliary bearing assembly includes angular contact bearings.

17. The rotary machine of claim 12, wherein the rotary machine further comprises a bearing post centered along the axis of rotation, and wherein the first auxiliary bearing assembly is positioned between the bearing post and the first rotor.

* * * * *